US005373124A

United States Patent [19]

Abendroth et al.

[11] Patent Number: 5,373,124

[45] Date of Patent: Dec. 13, 1994

[54] ACCELERATION SWITCH

[75] Inventors: Manfred Abendroth, Marbach/Neckar; Harry Kaiser, Markgroeningen, both of Germany

[73] Assignee: Robert Bosch GmbH, Stuttgart, Germany

[21] Appl. No.: 120,536

[22] Filed: Sep. 10, 1993

[30] Foreign Application Priority Data

Nov. 19, 1992 [DE] Germany ..... 4238880

[51] Int. Cl.[5] ..... H01H 35/14; H01H 9/00

[52] U.S. Cl. ..... 200/61.45 R; 200/61.52; 335/205

[58] Field of Search ..... 200/61.45 R, 61.53, 200/61.45 M; 335/205-207; H01H 36/00, 35/14

[56] References Cited

U.S. PATENT DOCUMENTS

| | | | |
|---|---|---|---|
| Re. 30,570 | 4/1981 | Hurt | 200/61.39 |
| 3,778,572 | 12/1973 | Matsui et al. | 200/61.45 M |
| 3,795,780 | 3/1974 | Lawrie | 200/61.45 R |
| 5,010,216 | 4/1991 | Sewell et al. | 200/61.45 M |
| 5,050,026 | 9/1991 | Goss | 360/106 |
| 5,153,394 | 10/1992 | Abendroth et al. | 200/61.52 |
| 5,256,839 | 10/1993 | Gallagher | 200/61.52 |

FOREIGN PATENT DOCUMENTS 4036567 9/1990 Germany .

*Primary Examiner*—J. R. Scott
*Attorney, Agent, or Firm*—Michael J. Striker

[57] ABSTRACT

An acceleration switch has a housing having a housing recess, an elongated tilting body located in the housing recess and operating as a seismic mass, a magnetic system, and a reed switch. The tilting body is arranged so that upon exceeding of a predetermined threshold value a control signal is released by interaction of the magnetic system and the reed switch. The magnetic system includes at least two permanent magnets having opposite polarization directions and connected with a magnetic flux conducting body at an end side facing away from the reed switch. The reed switch has contacts located in a magnetic field between the permanent magnets. The polarization directions of the permanent magnets extend perpendicular to a longitudinal axis of the tilting body. The contacts of the reed switch are arranged in a tilting direction of the tilting body.

3 Claims, 1 Drawing Sheet

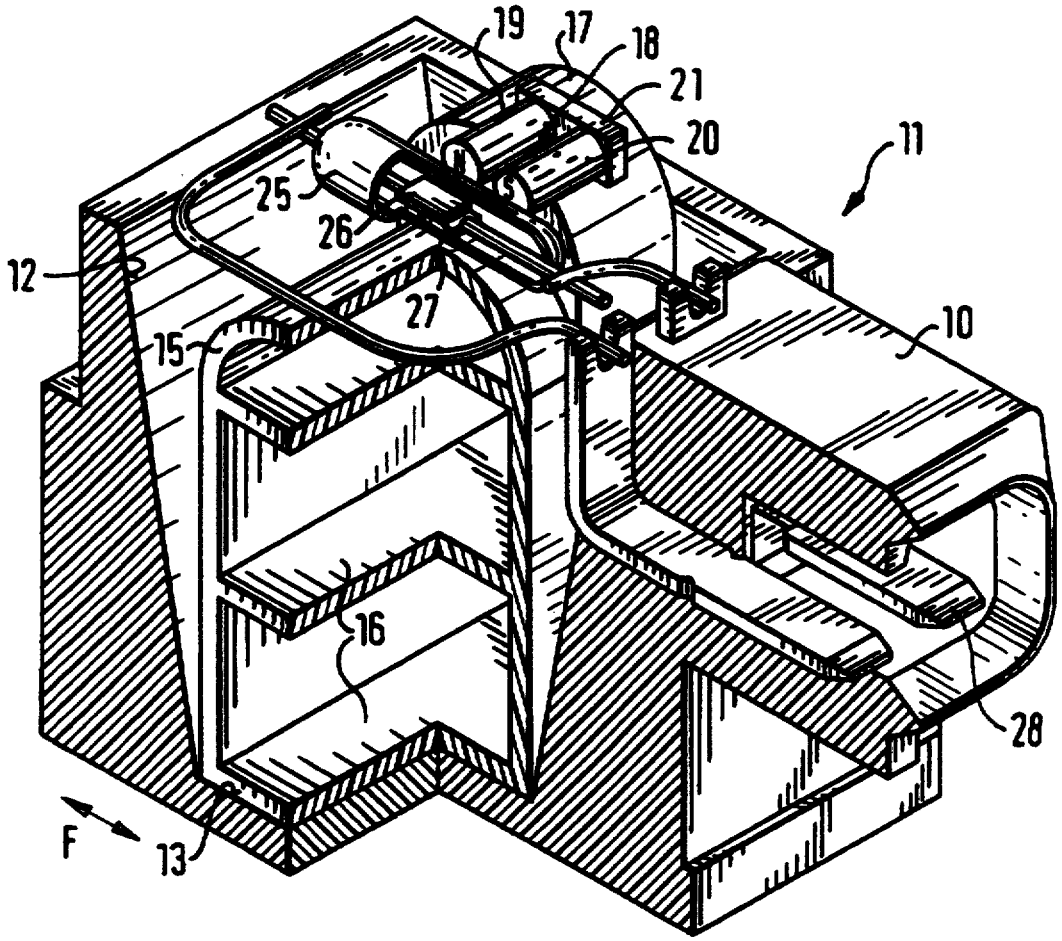
19
17
18
21
20
11
25
26
12
27
10
15
16
28
F
13

ACCELERATION SWITCH

BACKGROUND OF THE INVENTION

The present invention relates to an acceleration switch.

More particularly, it relates to an acceleration switch which has a tilting body operating as a seismic mass and releasing a control signal upon exceeding a predetermined threshold value.

Acceleration switches of the above-mentioned general type are known in the art. In a known acceleration switch a tilting body is an elongated member and operates as a seismic mass in a bucket-shaped housing. A permanent magnet is arranged in an end side of the tilting body and is in operative connection with a reed switch. Due to the alternating action between the permanent magnet and the metal contacts of the reed switch, a relatively low pulling force of the tilting body is provided. Thereby, the rate force of the tilting body is insignificantly changed, which leads to a dispersion of the release values of different acceleration switches in a series. This air gap-dependent dispersion of the release value influences the reliability of the acceleration switch disclosed in the German patent document DE-OS 40 36 567.0.

SUMMARY OF THE INVENTION

Accordingly, it is an object of the present invention to provide an acceleration switch which avoids the disadvantages of the prior art.

In keeping with these objects and with others which will become apparent hereinafter, one feature of the present invention resides, briefly stated, in an acceleration switch of the above-mentioned general type in which the magnetic system includes at least two permanent magnets with opposite polarization directions which at an end side facing away from the reed switch are connected with a magnetic flux guiding body, the contacts of the reed switch are located in a magnetic field located between the permanent magnets, and the polarization directions of the permanent magnets extend perpendicular to the longitudinal axis of the tilting body and the contacts of the reed switch are arranged in a tilting direction of the tilting body.

When the acceleration switch is designed in accordance with the present invention, it has the advantage that the different switches of a large series has a low dissipation of the release values. Therefore the switch is suitable for a large series. It can be easily exchanged with the acceleration switches utilized in the praxis. The principle that in a not-actuated condition a two-polar switch must be closed is no longer applicable. Thereby it is possible that when the current is interrupted at any location, a release signal is automatically produced. The required release paths and release times are relatively short, so that even with a small tilting of the tilting body, the connected protective devices in a motor vehicle can be released.

In accordance with another feature of the present invention, the permanent magnets in the reed switch are arranged in a plane perpendicular to the longitudinal axis of the tilting body.

Still another feature of the present invention is that the magnetic system is arranged in a projection of the tilting body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawings is a perspective view showing an acceleration switch in accordance with the present invention.

DESCRIPTION OF A PREFERRED EMBODIMENT

An acceleration switch identified as a whole with reference numeral 11 has a substantially bucket-shaped housing 10 with an inner chamber formed by side walls 12 with a constantly increasing angle $\alpha$. The magnitude of the angle $\alpha$ is determined by the maximum permissible hysteresis of the tilting angle. The tilting angle is determined by a required release angle or a release acceleration of the acceleration switch 11.

An elongated tilting body 15 is located on a bottom 13 of the inner chamber and operates as a seismic mass. As shown in the drawing, the tilting body 15 has a rectangular cross-section, and the short side is formed in a tilting direction F. Therefore a definite tilting direction of the tilting body 15 is obtained and as a result there is a definite release direction of the acceleration sensor 11. In other words, the acceleration switch 11 reacts only in the direction of acting accelerations. The tilting body 15 further has two chambers 16 which are used for insertion of filling bodies for changing the center of gravity of the tilting body 15. By changing the center of gravity of the tilting body 15, the release threshold of the acceleration sensor 11 can be influenced. The edges of the tilting body 15 which face the bottom 13 are slightly rounded. In particular, they must have an exactly defined shaped for switches of a whole series, in order to provide an exact, easy and reproducible tilting of the tilting body inside the inner chamber of the housing 10. At the end side of the tilting body 15, which is located opposite to the bottom 13, the tilting body is provided with a projection 17 in which a magnetic system 18 is located.

The magnetic system 18 is composed of two axially magnetized permanent magnets 19 and 20. Their polarization directions extend parallel to their longitudinal axes. Furthermore, both permanent magnets 19 and 20 are arranged substantially parallel near one another. Their axes and their polarization directions extend perpendicular to the tilting direction or parallel to the longitudinal axis of the rectangular cross-section of the tilting body 15. The permanent magnets 19 and 20 are polarized oppositely, so that the permanent magnet 19 with the north pole and the permanent magnet 20 with the south pole are located substantially flush with the outer wall of the projection 17. It is to be understood that a polarization of both permanent magnets is also possible in opposite directions. Furthermore, the other end sides of both permanent magnets 19 and 20 are connected with the magnetic flux conducting body 21. For example, the flux conducting body can be formed as a joint metal yoke sheet. By means of the flux conducting body 21, the north pole and the south pole of the permanent magnets 19 and 20 are connected with one another. In this way a narrowly limited dissipation flux is produced on the free end sides of both permanent magnets 19 and 20 which are opposite to the flux conducting body 21.

A reed switch 25 is located opposite to the free end sides of the permanent magnets 19 and 20, or in other words at the side facing away from the flux conducting member 21. The reed switch is illustrated by its contour only, so that the upper contact 26 and the lower contact 27 can be recognized. The first contact 26 is connected with one pole of the two-polar block 28 formed on the housing 10. The second contact 27 is connected with another pole of the block 28. The acceleration switch 11 can be connected with a control device and further with passenger protecting devices for the passengers of a motor vehicle by the switch 28. Further, both contacts 26 and 27 of the reed switch 25 are arranged in a tilting direction of the tilting body 15 or in other words perpendicularly to the axes of both permanent magnets 19 and 20. Since the projection 17 does not surround the whole width of the tilting body 15, the reed switch 25 can be arranged near the magnetic system 18. This means that the magnetic system 18 and the reed switch 25 can be located in one plane near one another. Therefore it is possible that the magnetic system 18 can apply no pulling force on the tilting body 15 by dissipation flux in connection with the contacts 26 and 27 of the reed switch 25.

Furthermore, both contacts 26 and 27 in the base position of the acceleration switch 11 are located substantially in the magnetic axis of the magnetic system 18. Since due to the flux conducting body 21 a magnetic field with a narrowly limited dissipation flux is produced at the end sides of both permanent magnets 19 and 20 which face the reed switch, a concentrated magnetic field is formed. The direction of the magnetic field again reverses within a small path which is predetermined by the distance of both permanent magnets 19 and 20. Thereby only a short tilting path of the tilting body 15 is required for releasing the acceleration switch 11. In particular, in view of the latter arrangement of the reed switch 25 relative to the magnetic system 18, the force action of both permanent magnets 19 and 20 onto the contacts 26 and 27 of the reed switch 25 has no influence on the release or tilting angle of the tilting body 15. It is to be understood that the tilting body, especially in the region of the magnetic system 18, or in other words, for example, in the projection 21, must be composed of a magnetically non-conducting material. Synthetic plastic material can be used for example for this purpose. In order to influence the center of gravity, one or several S bodies can be inserted in the chambers 16. With this arrangement of the permanent magnets and the contacts of the reed switch 25, a very short tilting path of the tilting body 15 is produced and therefore correspondingly a small hysteresis of the switching process of the acceleration switch 11 is obtained. The distance between both permanent magnets 19 and 20 must be not greater than the overlapping region of both contacts 26 and 27 of the reed switch 25.

When the acceleration switch 11 is located in its base position, or in other words in the position shown in the drawing, the contacts 26 and 27 of the reed switch 25 are arranged substantially in the magnetic axis of the magnetic system 18 and thereby opposite to the poles of both permanent magnets 19 and 20. In a known manner, the magnetic flux of both permanent magnets extends from the north poke of one permanent magnet 19 to the south pole of another permanent magnet 20. The magnetic flux is closed on the end side of both permanent magnets 19 and 20 by means of the flux guiding member 21. At the end side facing away from the flux guiding member 21, the magnetic flux extends through the air gap between the permanent magnets 19,20 and the reed switch 25 and through the contacts 26 and 27 of the reed switch 25. Due to the magnetic flux, both contacts 26 and 27 assume a different polarity, so that the contacts 26 and 27 are attracted in the base position. Thereby the contacts of the reed switch 25 are closed, which means a closed current circuit. The closed current circuit is needed so as to make the acceleration switch 11 compatible to already utilized switches and also to make it exchangeable with the utilized tilting switch in a simple manner without influencing the other structure.

When an acceleration acts on the switch 11, or the switch is tilted by an angle, the tilting body 15 tilts about its tilting axis. The magnetic system 18 is moved relative to the reed switch 25 from the above-described base position. The tilting of the body 15 acts so that the magnetic field of both permanent magnets 19 and 20 is closed. The reed switch 15 to the contrary is arranged stationarily in the housing 10 and does not change its position under the action of acceleration. In the tilted position of the tilting body 15 the flux lines of the magnetic field of both permanent magnets 19 and 20 extend only through one contact 26 or 27 of the reed switch 25. The flow of the flux conducting lines through a respective one of the contacts 26 and 27 depends on the direction of the tilting of the tilting body 15. Thereby in the tilted condition, only one of the two contacts of the reed switch 25 is influenced by the magnetic field. The other contact is substantially magnetically neutral, and therefore only low magnetic forces act between the contacts 26 and 27. The contacts 26 and 27 therefore no longer attract, so that the reed switch 25 in the tilted condition of the tilting body is open. As a result, the current circuit is interrupted and this leads to a release signal and therefore a release of passenger protecting devices.

It will be understood that each of the elements described above, or two or more together, may also find a useful application in other types of constructions differing from the types described above.

While the invention has been illustrated and described as embodied in an acceleration switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An acceleration switch, comprising a housing having a housing recess; a tilting body located in said housing recess tiltably in a tilting direction and operating as a seismic mass, said tilting body being elongated; a magnetic system connected with one of said housing and said tilting body; a reed switch connected with another of said housing and said tilting body, said tilting body being arranged so that upon its tilting over a predetermined threshold value a control signal is released by interaction of said magnetic system and said reed switch, said magnetic system including at least two permanent magnets having opposite polarization directions and connected with a magnetic flux conducting body at an end side facing away from said reed switch, said reed switch having contacts located in a magnetic field between said permanent magnets, said polarization directions of said permanent magnets extending perpendicular to a longitudinal axis of said tilting body, said contacts of said reed switch extending in the tilting direction of said tilting body.

2. An acceleration switch as defined in claim 1, wherein said permanent magnets and said reed switch are arranged in a plane extending perpendicular to the longitudinal axis of said tilting body.

3. An acceleration switch, comprising a housing having a housing recess; a tilting body located in said housing recess tiltably in a tilting direction and operating as a seismic mass, said tilting body being elongated; a magnetic system connected with one of said housing and said tilting body; a reed switch connected with another of said housing and said tilting body, said tilting body being arranged so that upon its tilting over a predetermined threshold value a control signal is released by interaction of said magnetic system and said reed switch, said magnetic system including at least two permanent magnets having opposite polarization directions and connected with a magnetic flux conducting body at an end side facing away from said reed switch, said reed switch having contacts located in a magnetic field between said permanent magnets, said polarization directions of said permanent magnets extending perpendicular to a longitudinal axis of said tilting body, said contacts of said reed switch extending in the tilting direction of said tilting body, said tilting body having a projection, said magnetic system being arranged in said projection of said tilting body.

* * * * *